United States Patent [19]

Raasch

[11] 4,083,170

[45] Apr. 11, 1978

[54] DEVICES FOR REPLACING THE SLIVER CONTAINERS IN A ROTOR SPINNING MACHINE

[75] Inventor: Hans Raasch, Monchengladbach, Germany

[73] Assignee: W. Schlafhorst & Co., Monchengladbach, Germany

[21] Appl. No.: 714,980

[22] Filed: Aug. 16, 1976

[30] Foreign Application Priority Data

Aug. 16, 1975 Germany ..... 2536497
Jul. 10, 1976 Germany ..... 2631141

[51] Int. Cl.[2] ..... D01H 9/18

[52] U.S. Cl. ..... 57/34 R; 19/159 A; 57/106; 211/78; 248/131

[58] Field of Search ..... 57/34 R, 58.89–58.95, 57/90, 106; 19/157, 159 A; 28/21; 211/77–78; 248/131

[56] References Cited

U.S. PATENT DOCUMENTS

| | | | |
|---|---|---|---|
| 3,382,543 | 5/1968 | Roberts et al. | 19/159 A |
| 3,716,979 | 2/1973 | Handschuck et al. | 57/34 R |
| 3,871,087 | 3/1975 | Savageau et al. | 19/159 A |
| 3,884,026 | 5/1975 | Yoshizawa et al. | 57/34 R |

FOREIGN PATENT DOCUMENTS

| | | | |
|---|---|---|---|
| 1,202,194 | 9/1965 | Germany | 19/159 A |

*Primary Examiner*—Richard C. Queisser
*Assistant Examiner*—Charles Gorenstein
*Attorney, Agent, or Firm*—Herbert L. Lerner

[57] ABSTRACT

In a rotor spinning machine having a multiplicity of spinning stations and sliver containers disposed in tandem in two rows, a device for replacing the sliver containers includes a rotary table having means for carrying four sliver containers for a respective group of four spinning stations.

11 Claims, 5 Drawing Figures

FIG.1
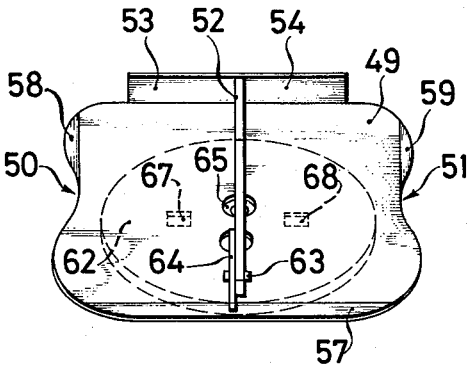
FIG.2
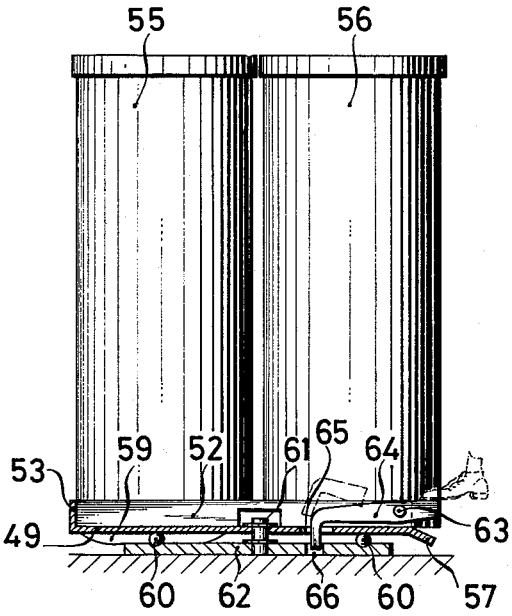
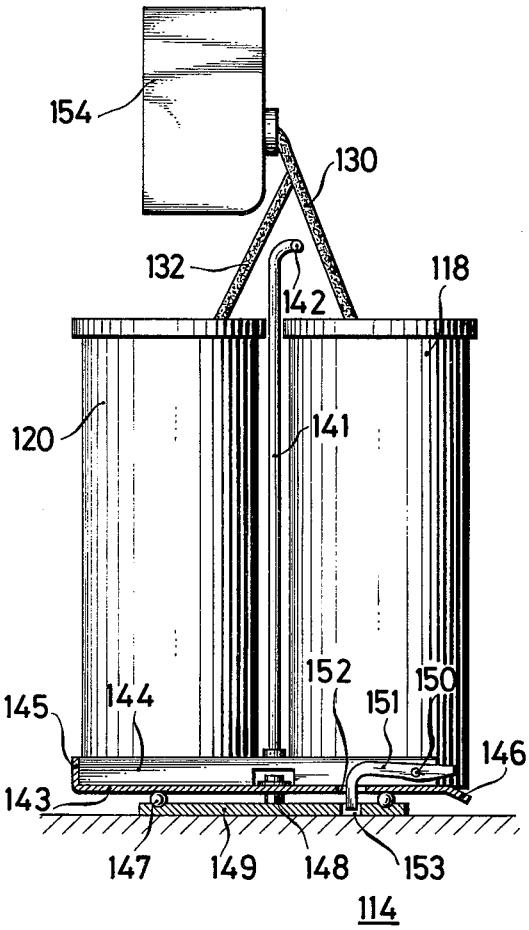
FIG.4

DEVICES FOR REPLACING THE SLIVER CONTAINERS IN A ROTOR SPINNING MACHINE

The invention relates to a device for replacing the sliver containers in a rotor spinning machine that has sliver containers disposed in tandem in two rows.

In rotor spinning machines, the sliver containers for the slivers that are to be processed are usually disposed below the spinning devices. As the working width of the individual spinning stations is small, the sliver containers must accordingly be disposed in tandem in two rows. The accessibility of the rear row is poor. To replace a sliver container of the rear row thereof, the procedure heretofore required was that, initially the container of the frontrow in front of the rear container to be replaced was pulled out and only then, the container of the rear row that was to be replaced was pulled out, replaced by a new container which was pushed back into place and, finally, the container of the front row was pushed back again. In the interim, the sliver of the container pulled out of the front row continues to run into the respective spinning station.

A disadvantage of this replacement procedure is the physical load placed on the operating personnel, the loss of time and the possibility of disturbance or trouble due to stretching, tearing or entanglement of the sliver of a container that has been moved or of a container adjacent thereto.

It is accordingly an object of the invention to provide a device for replacing the sliver containers in a rotor spinning machine which avoids the foregoing disadvantages of the heretofore known devices of this general type.

With the foregoing and other objects in view, there is provided, in accordance with the invention, in a rotor spinning maching having a multiplicity of spinning stations and sliver containers disposed in tandem in two rows, a device for replacing the sliver containers comprising a rotary table having means for carrying four sliver containers for a respective group of four spinning stations.

In accordance with another feature of the invention, the rotary table is rotatable to the right and to the left i.e. clockwise and counterclockwise, advantageously through substantially 90° from a middle position thereof into respective end positions, and is optionally lockable in the middle position and in the end positions. By rotating the rotary table, a rearwardly disposed sliver container can now be brought to the front without great effort, while all four sliver containers participate in the rotary motion of the table, the position thereof relative to one another being unchanged, however.

The individual rotary tables disposed adjacent one another can be moved especially close together if, in accordance with a further feature of the invention, the rotary table has a platform having a surface shape conforming substantially to the cross section of the four containers. The surface of the platform may, for example, have an area defining a square with rounded corners and possibly with additional lateral saddle-shaped depressions or indentations. If somewhat more space is available, a simple circular shape may also be advantageous.

In accordance with an additional feature of the invention, the rotary table has a middle bar and end stops for the sliver containers.

To facilitate loading and unloading, in accordance with an added feature of the invention, the platform of the rotary table has inclined run-up surfaces for the sliver containers, the run-up surfaces being formed by bends in the platform. The run-up surfaces for the two front sliver containers are disposed in the front of the platform and for each of the rear sliver containers, laterally at the rear of the platform.

When replacing a rearwardly disposed container, the sliver of which is no longer connected to the associated spinning station or is already completely processed, the sliver of the spinning stations that are operating undisturbedly should be fed from the sliver containers as best as possible uncrossed or without any cross-over. To ensure this, in accordance with yet another feature of the invention, wherein the spinning stations of the respective group thereof are serially aligned, the rotary table is rotatable clockwise and counterclockwise from a middle position thereof into respective end positions, the two rearwardly disposed sliver containers in the middle position of the rotary table being respectively associated with the middle spinning stations of the serially aligned four spinning stations of the respective group, and the two forwardly disposed sliver containers in the middle position of the rotary table being respectively associated with the outer spinning stations of the serially aligned four spinning stations of the respective group.

The replacement of a sliver container forwardly disposed on the rotary table in the rest or neutral position thereof is not difficult. Replacement of a rearwardly disposed sliver container on the rotary table in the rest or neutral position thereof is somewhat more difficult, on the other hand, because, after rotating the rotary table through 90°, direct crossing and touching of various slivers occur, depending upon the association of the sliver containers to the individual spinning stations, and individual slivers must be fed freely suspended to the spinning stations over relatively long distances, whereby the slivers tend to sag and thereby impede the container-replacement operation.

The replacement of the sliver containers can be facilitated if the forwardly disposed sliver containers in the rest or neutral position as well as in the end position rotated 90° to the left or right-hand side i.e. clockwise or counterclockwise, are fed uncrossed and along the shortest path to the associated spinning stations.

In accordance with a further feature of the invention, this is accomplished by providing a device for replacing the sliver containers, wherein the spinning stations of the respective group thereof are serially aligned, and the rotary table is rotatable clockwise and counterclockwise from a middle position thereof into respective end positions, the two rearwardly disposed sliver containers in the middle position of the rotary table being respectively associated with the outer spinning stations of the serially aligned four spinning stations of the respective group, and the two forwardly disposed sliver containers in the middle position of the rotary table being respectively associated with both middle spinning stations of the serially aligned four spinning stations of the respective group.

If the rotary table is then rotated from the rest or initial position thereof clockwise through 90°, the sliver extends from the sliver container at the front right-hand side of the rotary table to the spinning station at the right-hand side of the group of four spinning stations, and from the sliver container at the front left-hand side of the rotary table to the second spinning station from the right-hand side of the group of four spinning stations. If the rotary table is rotated counterclockwise from the rest or initial position through 90°, then the sliver extends from the sliver container at the front left-hand side of the rotary table to the spinning station at the left-hand side of the group of four spinning stations, and from the sliver container at the front right-hand side of the rotary table to the second spinning station from the left-hand side of the group of four spinning stations. The front slivers thus do not cross each other. If one of the rearwardly disposed sliver containers in the rest or initial position has run out, it can be exchanged or replaced after the rotary table has been rotated through 90°, without interfering with the sliver supply being fed to an adjacent spinning station. The new starting end of the sliver can be introduced for rejoining into the associated spinning station without crossing another sliver.

Since sliver crossings are produced in the rearward part of the rotary table when the latter is rotated through 90°, In accordance with yet another feature of the invention, the device, wherein the spinning stations have respective housings disposed above the sliver containers, include a sliver separating rod connected to the rotary table and extending from the right-hand side to the left-hand side thereof above the sliver containers and below a respective spinning station housing, the sliver separating rod, in neutral position of the rotary table, being above substantially the middle of the rotary table below the travel path of the slivers extending from both of the forwardly disposed sliver container to both of the middle spinning stations, respectively.

In accordance with an added feature of the invention, the sliver separating rod has a length equal to at least double the diameter of one of the sliver containers.

When the rotary table is rotated through 90°, the sliver separating rod is also rotated through 90°. When the rotary table is rotated clockwise, the sliver separating rod supports those slivers which have to bridge, freely suspended, a relatively long travel path. These are the slivers which extend to the spinning station at the left-hand side of the group of four spinning stations and to the second spinning station from the right-hand side of the group of four spinning stations. When the rotary table is rotated through 90° clockwise from the rest or neutral position, the sliver separating rod likewise supports those fiber ribbons which extend, freely suspended, over a relatively long distance. These are the slivers leading to the spinning station at the right-hand side of the group of four spinning stations and to the second spinning station from the left-hand side of the group of four spinning stations.

The other slivers are not supported by the sliver separating rod in the two end positions of the rotary table, and are therefore located in each case beyond or below the sliver separating rod. The sliver separating rod thus assures that direct contact of mutually crossing slivers does not occur.

In accordance with a concomitant feature of the invention, the device includes an upright support secured to the middle of the rotary table, the support connecting the sliver separating rod to the rotary table. Enough space is always left in the middle of the rotary table to dispose such a support therein. At the same time, a support at this location does not interfere with the operation for replacement of the sliver containers or with the feeding of the slivers to the spinning stations.

The advantages attained by the invention are in particular that replacement of sliver containers can be effected more rapidly and with the use of less force than heretofore and that, during the replacement or exchange operation, undisturbed operation of the adjacent spinning stations is largely ensured. In addition, the sliver containers of the rearward row can be inspected conveniently and rapidly during operation at any time, which was not possible without difficulty heretofore.

Furthermore, especially with regard to the second embodiment disclosed herein, the invention facilitates the automation of the replacement of the sliver containers.

Other features which are considered as characteristic for the invention are set forth in the appended claims.

Although the invention is illustrated and described herein as embodied in devices for replacing the sliver containers in a rotor spinning machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a perspective view of an embodiment of the device for replacing sliver containers in a rotor spinning machine in accordance with the invention;

FIG. 2 is a longitudinal sectional view of the embodiment of FIG. 1 with sliver containers set in place thereon;

FIG. 4 is a view similar to that of FIG. 2 of another embodiment of the invention.

Figure 3:
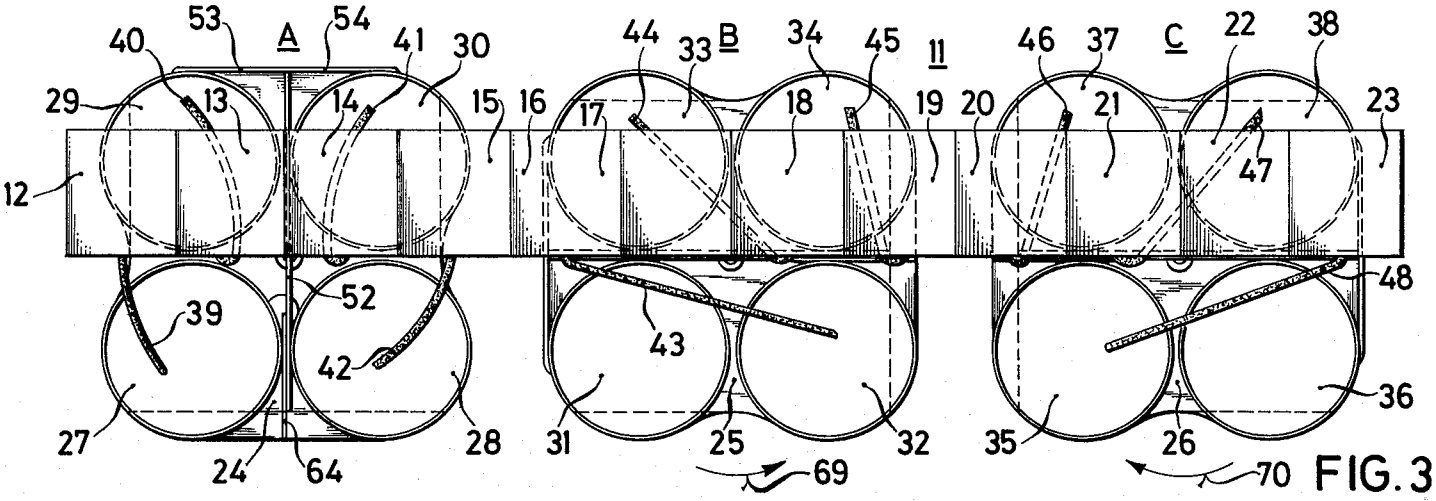
FIG. 3 is a diagrammatic top plan view of three groups of four spinning stations each of a spinning machine with embodiments of the device of FIG. 1 associated therewith.

Referring now to the drawing and first to FIG. 3 thereof, there is shown a rotor spinning machine 11 having three groups A, B and C formed of four spinning stations each. The group A of four stations includes the spinning stations 12, 13, 14 and 15; the group B of four stations, the spinning stations 16, 17, 18 and 19; and the group C of four stations, the spinning stations 20, 21, 22 and 23. Underneath the four spinning stations 12, 13, 14 and 15 of the group A, a rotary table 24 is disposed, underneath the group B of four stations, a rotary table 25, and underneath the group C of four stations, a rotary table 26.

Four sliver containers are disposed on each rotary table, namely, sliver containers 27, 28, 29 and 30 on the rotary table 24; sliver containers 31, 32, 33 and 34 on the rotary table 25; and sliver containers 35, 36, 37 and 38 on the rotary table 26. From the sliver container 27, a sliver 39 extends to the spinning station 12, from the sliver container 29, a sliver 40 to the spinning station 13, from the sliver container 30, a sliver 41 to the spinning station 14; from the sliver container 28, a sliver 42 to the spinning station 15; and from the sliver container 32, a sliver 43 to the spinning station 16. No sliver extends to the spinning station 17 because the sliver of the associated sliver container 31 has already been consumed. From the sliver container 33, a sliver 44 extends to the spinning station 18; from the sliver container 34, a sliver 45 to the spinning station 19; from the sliver container 37, a sliver 46 to the spinning station 20; and from the sliver container 38, a sliver 47 to the spinning station 21. No sliver extends to the spinning station 22, because the sliver container 36 associated therewith also is empty. From the sliver container 35, a sliver 48 extends to the spinning station 23.

The rotary tables 24, 25 and 26 are of identical construction. The specific embodiment thereof is shown especially in FIGS. 1 and 2. Each rotary table has a platform 49. The platform 49 has a surface shape closely fitting the cross section of the sliver containers, the area of the surface defining a square with rounded corners and lateral saddle-shaped depressions 50 and 51. The platform 49 has a middle bar or ledge 52 and end stops or abutments 53 and 54 for the sliver containers, of which the containers 55 and 56 are visible in FIG. 2. At the front thereof, the platform 49 has a rising or run-up surface 57 and at the rear thereof on the left-hand and the right-hand side, further rising or run-up surfaces 58 and 59, respectively. The run-up surfaces 57, 58 and 59 are formed by bending and serve for facilitating the introduction and removal of the sliver containers. The platform 49 is rotatable by means of a ball bearing 60 about a pin 61 which is connected to a base plate 62. A latch 64 equipped for foot operation is articulatingly secured to a pin 63 which is connected to the middle bar 52. The latch 64 is shaped so that it can, due to its own weight, extend downwardly through a hole 65 formed in the platform 49, and engage in a slot 66 formed in the base plate 62, and thereby lock the rotary table in the middle position thereof. The latch 64 can be unlocked by foot operation. The base plate 62 has two stops or abutments 67 and 68, against which the latch 64 comes to rest in the end positions of the rotary table. It is therefore not possible to turn the rotary table beyond the end positions thereof. Locking the rotary table in the end positions is dispensed within the embodiment of the invention shown in FIGS. 1 and 2.

It is apparent from FIG. 3 that the sliver containers 27, 28, 29 and 30 are disposed on the rotary table 24 in such a manner that the two rear sliver containers 29 and 30 (shown at the tope of FIG. 3) are associated with the two middle spinning stations 13 and 14, and the two front sliver containers 27 and 28 (shown at the bottom of FIG. 3) with the two outer spinning stations 12 and 15 of the group A of four spinning stations. Similarly, this arrangement applies also to the groups B and C of four spinning stations each, with the air of which the advantage of the arrangement according to the invention is demonstrated in FIG. 3.

Since the sliver container 31 has run empty, the rotary table 25 has already been rotated 90° to the right-hand side in direction of the arrow 69 i.e. counterclockwise as viewed in FIG. 3, in order to replace the container 31. Also, in this position or setting, the slivers continue to run to the undisturbed spinning stations without crossing or touching one another.

The sliver container 36 of the group C of four stations is also empty. To replace the container 36, the rotary table 26 has already been rotated 90° to the left-hand side in direction of the arrow 70 i.e. clockwise as viewed in FIG. 3. In this position or setting, also, the slivers continue to run to the undisturbed spinning stations without crossing or touching one another.

Figure 5:
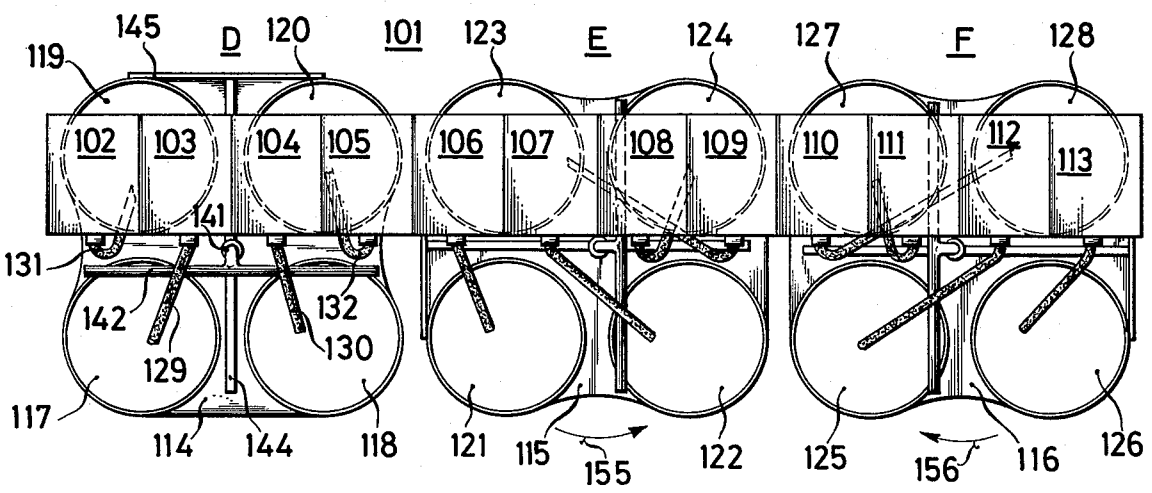
FIG. 5 is a view similar to that of FIG. 3 including embodiments of the device of FIG. 4.

According to FIG. 5, a rotor spinning machine 101 has three groups D, E, and F of four spinning stations each. The group D includes the spinning stations 102 to 105, the group E, the spinning stations 106 to 109, and the group F, the spinning stations 110 to 113. Below the group D of four stations, a rotary table 114 is disposed, under the group E, a rotary table 115 and under the group F, a rotary table 116. Four sliver containers stand on each rotary table, namely, the sliver containers 117 to 120 on the rotary table 114, the sliver containers 121 to 124 on the rotary table 115, and the sliver containers 125 to 128 on the rotary table 116.

It is apparent from FIG. 5 that, in the case of group D of four stations, the rotary table 114 is in the rest or neutral position. From the two front sliver containers 117 and 118, as viewed from the bottom of FIG. 5, slivers 129 and 130 run to the two spinning stations 103 and 104 in the middle of the group D of four spinning stations 102 to 105. From the two rear sliver containers 119 and 120, as viewed from the bottom of FIG. 5, slivers 131 and 132 run to the two outer spinning stations 102 and 105 of the same group D of four spinning stations. A support 141 is fastened in the middle of the rotary table 114 and carries, at the upper end thereof a sliver separating rod 142. The sliver separating rod 142 extends from left-hand to the right-hand side, as viewed in FIG. 5, above the sliver containers 117 and 118 and below the slivers 129 and 130 which extend from the sliver containers 117 and 118 to the spinning stations 103 and 104.

The cross sectional view of the rotary table 114 shown in FIG. 4 shows that the rotary table 114 has a platform 143. The platform 143 has a surface shape which fits the cross section of the containers, the area of the surface defining a square with rounded corners and lateral saddle-shaped depressions (FIG. 5). The platform 143 has a middle bar or ledge 144 and an end stop or abutment 145 for the sliver containers, only the containers 118 and 120 being visible in FIG. 4. At the front thereof, as viewed from the right-hand side of FIG. 4, the platform 143 has a rising or run-up surface 146. The platform 143 is rotatable by means of a ball bearing 147 about a pin 148, which is connected to a base plate 149. At a pin or bolt 150 connected to the middle bar 144, a latch 151 is articulatingly connected for foot operation or selectively automatic operation. The latch 151 is shaped so that it can, due to its own weight, extend downwardly through a hole 152 formed in the platform 143, into a slot 153 formed in the base plate 149, and thereby lock the rotary table in the central position or setting thereof. The latch 151 can be unlocked either by foot operation or by automatic operation.

It is also apparent from FIG. 4 that the support 141 in the middle of the rotary table 114 is fastened on the middle bar 144 and extends to just below the housing 154 of the spinning station, where it is bent toward the front and carries the sliver-separating rod 142. It is also recognizable in FIG. 4 that the sliver-separating rod 142 is disposed below the sliver 130, extending out of the front spinning can 118, and in front of the sliver 132 extending from the rear spinning can 120, as viewed from the right-hand side of FIG. 4. In the base or neutral position of the rotary table 114, contact of the slivers with the sliver-separating rod 142 is merely accidental. Only when the rotary table 114 is rotated does the sliver-separating rod 142 support, in the aforedescribed manner, the two slivers that are freely suspended over an especially great distance, so that contact with the shorter slivers or with the upper edge of the sliver containers is avoided.

It is evident from FIG. 5 that the rotary table 115 of the group E of four spinning stations 106 to 109 is rotated counterclockwise in direction of the arrow 155 from the rest or neutral position through 90°. Such a rotation occurs during operation for the purpose of exchanging or replacing the spinning can 121 which stands to the rear in the rest or neutral position. It is apparent from FIG. 5 of the drawing that such a replacement cannot interfere with the operation of the other spinning stations. The rotary table 116 of the group F of four stations 110 to 113 is rotated from the rest or neutral position thereof through 90° clockwise in direction of the arrow 156. This rotation occurs operationally for the purpose of replacing the rear-ward disposed container 126 in the rest or neutral position or setting. It will be noted from FIG. 5 of the drawing that also in this case, a replacement of the sliver can or container is possible without interference with the operation of the other spinning stations.

As mentioned hereinbefore, the invention of the instant application is not limited to the illustrated and described embodiments. The construction of the embodiments depends, among other things, also on the given physical or spatial relationships of the spinning machine.

There are claimed:

1. A rotor spinning machine having a multiplicity of spinning stations and sliver containers disposed in tandem in two rows, comprising a device for replacing empty containers with containers filled with sliver including a rotary table having means for carrying four sliver containers for respective groups of four spinning stations each.

2. Device according to claim 1 wherein said rotary table has a platform having a surface shape conforming substantially to the cross section of the four containers.

3. Device according to claim 1 wherein said rotary table has a middle bar and end stops for the sliver containers.

4. Device according to claim 2 wherein said platform has inclined run-up surfaces for the sliver containers, said run-up surfaces being formed by bends in said platform.

5. In a rotor spinning machine having a multiplicity of spinning stations and sliver containers disposed in tandem in two rows, a device for replacing the sliver containers comprising a rotary table having means for carrying four sliver containers for a respective group of four spinning stations, said rotary table being rotatable clockwise and counterclockwise from a middle position thereof into respective end positions.

6. Device according to claim 5 wherein said rotary table is rotatable through substantially 90° into said respective end positions from said middle position thereof.

7. Device according to claim 5 wherein the spinning stations of the respective group thereof are serially aligned, the two rearwardly disposed sliver containers in said middle position of said rotary table being respectively associated with the middle spinning stations of the serially aligned four spinning stations of the respective group, and the two forwardly disposed sliver containers in said middle position of said rotary table being respectively associated with the outer spinning stations of the serially aligned four spinning stations of the respective group.

8. Device according to claim 5 wherein the spinning stations of the respective group thereof are serially aligned, the two rearwardly disposed sliver containers in said middle position of said rotary table being respectively associated with the outer spinning stations of the serially aligned four spinning stations of the respective group, and the two forwardly disposed sliver containers in said middle position of said rotary table being respectively associated with both middle spinning stations of the serially aligned four spinning stations of the respective group.

9. Device according to claim 8 wherein the spinning stations have respective housings disposed above the sliver containers, and including a sliver separating rod connected to said rotary table and extending from the right-hand side to the left-hand side thereof above the sliver containers and below a respective spinning station housing, said sliver separating rod, in neutral position of said rotary table, being above substantially the middle of said rotary table below the travel path of the slivers extending from both of the forwardly disposed sliver containers to both of the middle spinning stations, respectively.

10. Device according to claim 9 wherein said sliver separating rod has a length equal to at least double the diameter of one of the sliver containers.

11. Device according to claim 9 including an upright support secured to the middle of said rotary table, said support connecting said sliver separating rod to said rotary table.

* * * * *